United States Patent [19]

Clemmow et al.

[11] Patent Number: 4,573,744

[45] Date of Patent: Mar. 4, 1986

[54] PICK AND THE COMBINATION OF A PICK AND HOLDER

[75] Inventors: Raymond J. Clemmow, Dronfield Woodhouse; Leonard Radford, Meersbrook; John D. Thorpe, Sheffield, all of England

[73] Assignee: Padley & Venables Limited, Dronfield, England

[21] Appl. No.: 679,249

[22] Filed: Dec. 7, 1984

Related U.S. Application Data

[63] Continuation of Ser. No. 322,451, Nov. 18, 1981, Pat. No. 4,488,758.

[30] Foreign Application Priority Data

Nov. 24, 1980 [GB] United Kingdom ..... 8037567

[51] Int. Cl.[4] ..... E21B 10/18; E21C 7/08; E21F 5/02

[52] U.S. Cl. ..... 299/81; 175/393

[58] Field of Search ..... 299/81, 79; 175/339, 175/393, 340; 285/305; 279/20

[56] References Cited

U.S. PATENT DOCUMENTS

| | | | |
|---|---|---|---|
| 1,009,302 | 11/1911 | Hansen | 279/20 |
| 2,868,512 | 1/1959 | Sease | 175/340 |
| 4,022,287 | 5/1977 | Lundstrom et al. | 175/393 |
| 4,201,421 | 5/1980 | Den Besten et al. | 299/92 X |

FOREIGN PATENT DOCUMENTS

| | | | |
|---|---|---|---|
| 2036127 | 6/1980 | United Kingdom | 299/81 |
| 2067625 | 7/1981 | United Kingdom | 299/81 |
| 2104945 | 3/1983 | United Kingdom | 299/81 |

OTHER PUBLICATIONS

Acco Mining Sales, "Thru-Flush", 10/1982.

*Primary Examiner*—Stephen J. Novosad
*Assistant Examiner*—M. Goodwin
*Attorney, Agent, or Firm*—Finnegan, Henderson, Farabow, Garrett & Dunner

[57] ABSTRACT

A mineral mining pick 1, a holder for such a pick, and the combination of such a pick with a holder 2. The pick has a head 3 with a cutting tip 5 and a shank 4 which is received in a shank socket 6 of the holder 2. Retaining means 7 is provided to releasably secure the pick in the holder. Extending through the pick is a water passage 11 which communicates with outlet ports 12 in the pick head for water flow to suppress dust and cool the tip 5. The passage 11 communicates with a socket 15 which mates with a tubular spigot 13 which is an extension to a fluid supply passage 2a in the holder 2. The spigot 13 is mounted by a resilient sleeve 22 in a tubular housing 19 by which it is removably retained in the holder 2. The sleeve 22 permits displacement of the spigot 13 to accommodate misalignment between the spigot and the socket 15 during coupling thereof as the shank is inserted into its socket 6.

The socket 6 is provided with a plastics moulded lining 23 which is replaceable when worn to alleviate wear on the holder 2.

In a modification the tubular spigot is carried by (and may be integral with) the pick shank for mating with a fluid coupling socket in the shank socket 6.

14 Claims, 6 Drawing Figures

Figure 1:
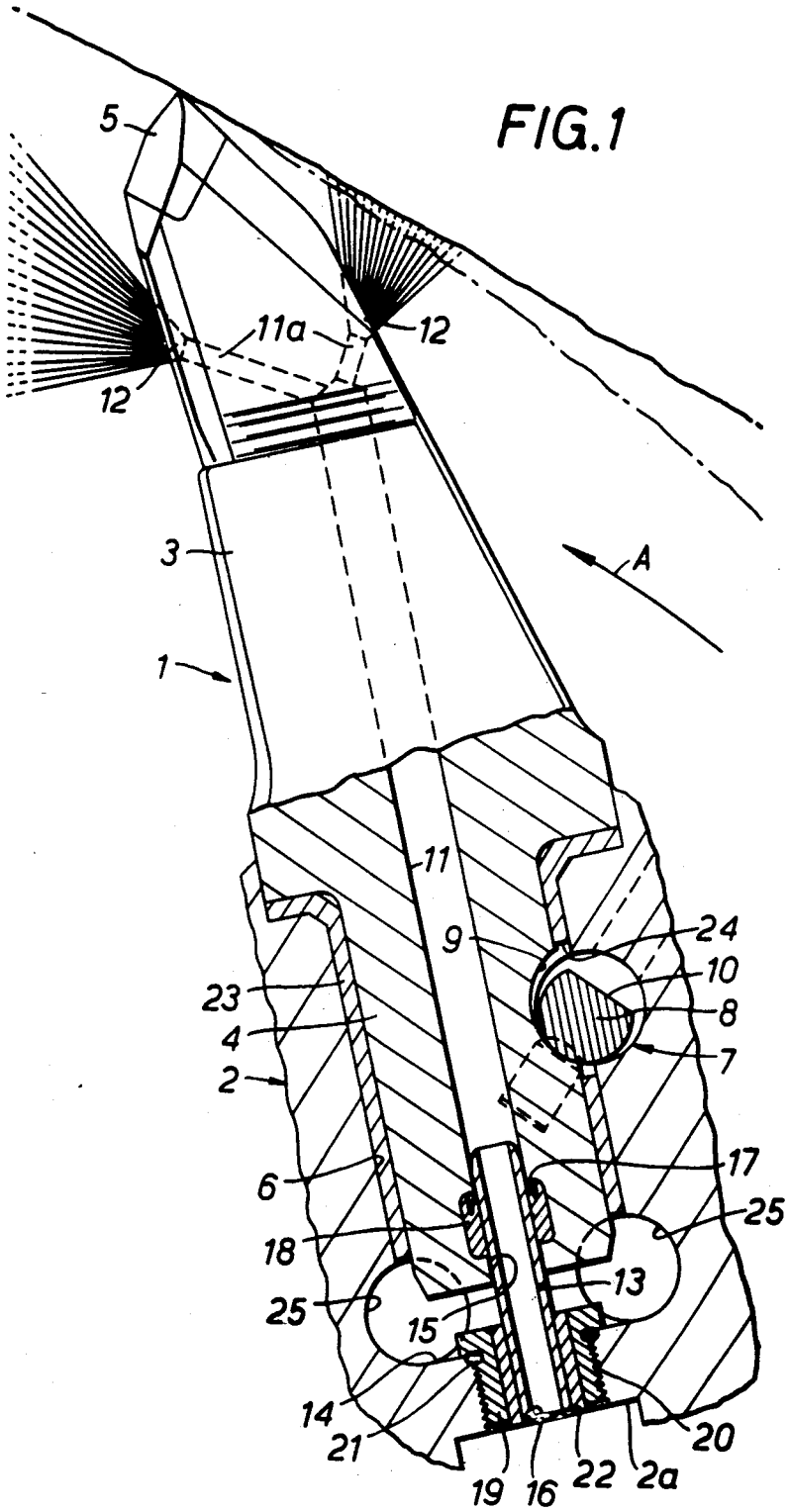

5
11a
12
12
3
A
1
11
9
24
10
8
7
23
4
2
6
17
25
18
13
25
15
14
21
20
19
16
22
2a

PICK AND THE COMBINATION OF A PICK AND HOLDER

This is a continuation of application Ser. No. 06/322,451, filed Nov. 18, 1981, now U.S. Pat. No. 4,488,758, Dec. 18, 1984.

DESCRIPTION

This invention relates to a pick and more particularly to a mineral mining pick (which term, as is generally acknowledged in the art, includes a pick for rock mining and road planing). The invention also relates to a pick holder, and the combination of a mineral mining pick and a pick holder where the pick holder is likely to be in the form of a socketed block or box on or in a driven drum of a mining machine but may be the drum itself.

In mineral mining with mechanically driven picks it is conventional practice, especially when coal cutting, to direct a fluid (which is usually water and will conveniently be referred to as such hereinafter) into the cutting region of the picks for the primary purposes of dust suppression, flushing and cooling. Dust suppression and cooling is an internal discipline which many mineral mining (particularly coal) authorities have accepted in an attempt to reduce the incidence of respiratory diseases such as pneumoconiosis and also to alleviate the possibility of local gas ignition and thereby the risk of explosion due to pick temperature.

Cooling and dust suppression by applying a spray or jet of water on to the mineral face and over the picks in the cutting region is well known. In a conventional coal shearer drum an array of picks are secured in holding blocks which are helically spaced around the peripheral edge of a helical web or flange which is formed as part of the drum. The web or flange extends radially outwardly relative to the axis of the drum to serve as a screw conveyor for displacing coal or other mineral axially over the drum during its rotation and coal cutting. With this conventional arrangement the web or flange carries an array of nozzles through which the water is intended to be jetted on to the cutting tips of the picks and there is a distinct possibility that the nozzles will be broken off or otherwise damaged during use of the mining machine because of their exposed locations on the drum. Reliability of mineral mining equipment is essential and efforts are constantly being made to reduce the "down-time" of machinery (that is the time the machinery is inoperative due to servicing or repair). Damage to the water nozzles as aforementioned will require the machine to be stopped for servicing and possibly the drum to be removed from site for repair of the nozzles. Furthermore, it is most desirable that the water is effectively applied so that the rate of water usage can be maintained at a minimum consistent with safety requirements. Too much water creates poor working conditions and problems in the transport and preparation of the mined mineral (especially coal) and therefore each water jet or spray should be directed accurately for optimum efficiency.

A mineral mining pick conventionally comprises a pick head with a cutting part (usually of a hard material such as a tungsten carbide insert) and a shank extending from the head by which the pack is retained in a complementary shaped socket on the driven drum. With such an arrangement it has previously been proposed by the disclosure in U.K. Patent Specification No. 2,008,170 for the shank and pick head to be provided with internal passages which emerge at ports in the head to direct water into the cutting region of the pick and in the free end of the shank. The port in the free end of the shank communicates with a water supply which is fed through the driven drum to the socket in which the shank is received. To prevent water from passing externally between the shank and socket, the shank is provided with a peripheral seal which compresses against the wall of the socket when the pick is fitted to the drum. By this technique water under pressure enters a sealed chamber in the socket at the inner end of the shank from where it flows through the internal passages of the pick for cooling and dust suppression purposes but there are, however, severe technical disadvantages in the proposal. To ensure its efficient use the pick must be restrained in and by the socket against displacement laterally and longitudinally with respect to the longitudinal extent of the socket; longitudinal restraint may be effected by conventional removably engageable locking or restraining means provided between the pick block, box or drum and the pick shank while lateral restraint is effected by having the shank a close tolerance fit within the socket. However, to permit the shank fitted with its peripheral seal to be inserted into the socket, sufficient clearance must be provided to accommodate the seal so that the latter can function efficiently—if the clearance is too small the seal can be damaged during fitting and if the clearance is too large the shank is not adequately restrained laterally, thus these requirements are incompatible. Also the clearance necessary to accommodate the seal is, with conventional restraining means between the pick shank and pick box or block, likely to reduce the efficiency of such retaining means. During use it is inevitable that the forces to which the pick is subjected will cause some longitudinal and lateral movement of the pick shank in its socket and this movement will increase with water. The rate of wear will increase the greater the clearance initially provided between the pick shank and its socket and the resultant displacement of the pick permitted by this wear will rapidly reduce the efficiency of the seal to the extent that water will leak from the socket; indeed this wear may quickly reach a hazardous situation where the properties of the retaining means are insufficient to hold the pick on the drum against the high water pressure applied to the inner end face of the pick shank in the water chamber and the centrifugal force on the pick during rotation of the drum.

There is also the disadvantage that during use of the pick detritus will enter the socket and settle in the sealed water chamber; from time-to-time this must, necessarily, be cleared which is both inconvenient and expensive since the equipment must be inoperative for such purpose.

It is an object of the present invention to provide a mineral mining pick, a holder for such a pick and also the combination of such a pick with a holder by which the aforementioned problems associated with conventional picks, holders and their flushing techniques can be alleviated so that the fluid for dust suppression, cooling and/or flushing can be utilised efficiently with the likelihood of distinctly reducing the "down-time" of the mining equipment caused by maintenance and repair of the flushing fluid system as a result of wear and tear on components in that system.

According to the present invention there is provided a mineral mining pick which comprises a body having a head with a cutting part and a shank which extends longitudinally from the head; passage means in the body for the flow of fluid under pressure therethrough to an outlet port by which such fluid is directed for dust suppression, cooling or flushing purposes, and wherein said shank has at its free end a tubular spigot the bore of which communicates with the passage means, said tubular spigot extending longitudinally of the shank for reception in a fluid coupling socket through which fluid is to be supplied to the passage means.

Further according to the present invention there is provided a mineral mining pick which comprises a body having a head with a cutting part and a shank which extends longitudinally from the head, passage means in the body for the flow of fluid under pressure therethrough to an outlet port by which such fluid is directed for dust suppression, cooling or flushing purposes, and wherein said shank has in its free end a longitudinally extending fluid coupling socket which communicates with the passage means, said coupling socket being intended to receive a tubular spigot through which fluid is to be supplied to the passage means and housing a sealing means for fluid sealing engagement with the tubular spigot.

Still further according to the present invention there is provided the combination of a mineral mining pick and a pick holder, said pick comprising a body having a head with a cutting part, a shank which extends longitudinally from the head and passage means in the body for the flow of fluid under pressure therethrough to an outlet port by which fluid is directed for dust suppression, cooling or flushing purposes; said holder comprising a shank socket within which the shank is longitudinally received, retaining means for releasably retaining the shank in the socket and a fluid supply passage communicating with the passage means in the pick body, and wherein one of said pick and pick holder members has a tubular spigot which extends longitudinally of the shank or socket and the bore of which is in fluid flow communication with the fluid passage of the member which carries it and the other of said pick and pick holder members has a fluid coupling socket which is in fluid flow communication with the fluid passage of its member and which longitudinally receives the tubular spigot during insertion of the shank into the shank socket to provide fluid flow communication between the fluid supply passage and the passage means in the pick body.

Another feature of the present invention is the provision of a holder for a mineral mining pick comprising a longitudinally extending shank socket within which a shank of a mineral mining pick is to be longitudinally received, and a tubular spigot located within and extending longitudinally of said shank socket, said tubular spigot being carried at the inner end of the shank socket and being in fluid flow communication with a fluid supply passage for mating in fluid sealing engagement with a fluid coupling socket in the pick shank of a pick received in the shank socket for the supply of fluid to passage means in the pick for dust suppression, cooling or flushing purposes.

Still another feature of the present invention is the provision of a holder for a mineral mining pick comprising a longitudinally extending shank socket within which a shank of a mineral mining pick is to be longitudinally received; a longitudinally extending fluid coupling socket located at the inner end of said shank socket and in fluid flow communication with a fluid supply passage in the holder, and sealing means in said fluid coupling socket so that said fluid coupling socket can receive, with fluid sealing engagement, a longitudinally extending tubular spigot on the pick shank of a pick received in the shank socket for the supply of fluid to passage means in the pick for dust suppression, cooling or flushing purposes.

By the present invention, which is readily applicable to pick shanks and shank sockets of any shape in lateral section, as well as the usual circular, rectangular or polygonal form, fluid flow communication between the water supply passage and the internal passage of the pick is to be effected through the tubular spigot as the shank is inserted into, and when retained in, the shank socket. The tubular spigot is intended to mate automatically and preferably in sealed manner with the fluid coupling socket as the pick is fitted to the pick holder and as such the spigot will be protected during use within the enclosure of the shank socket in the substantial body of the holder. The provision of such connection between the tubular spigot and fluid coupling socket permits adequate sealing against water leakage to be provided within the fluid coupling socket and thereby eliminates the requirement for a peripheral seal on the pick shank between that shank and the shank socket of the holder. This latter feature has the advantage that the pick shank can be formed as a relatively close tolerance fit with the shank socket to alleviate lateral displacement of the pick relative to the holder during use and thereby increase the efficiency of both the pick and the retaining means by which the pick is held in the holder. Furthermore, the use of a sealed water passageway through the co-operating tubular spigot and coupling socket avoids the formation of a chamber at the inner end of the shank socket which is subjected to water pressure and thereby avoids the application of water pressure on inner end face of the pick shank in a sense to displace the pick from its holder. The avoidance of such a water chamber in the shank socket between the inner end of that socket and the inner end face of the pick shank also permits one or more apertures to be provided through a side wall of the holder to connect with the inner end of the shank socket and through which aperture or apertures the removal of detritus from the shank socket can be facilitated and/or an appropriate tool may be inserted to assist in removal of the pick from the holder when required.

Although the present invention permits the pick shank to be formed as a relatively close sliding fit with the shank socket there will, nevertheless, be wear between the shank and its socket during prolonged use. With conventional pick and holder arrangements it is often necessary to replace a pick box or block the socket of which is worn and this obviously requires shut-down of the equipment and is an expensive servicing procedure. This disadvantage of conventional arrangements can be alleviated by providing the shank socket in the holder with a replaceable lining which is disposed between the shank and its socket. This lining is conveniently in the form of a sleeve in the shank socket within which sleeve the shank is received or alternatively by a lining carried by the pick shank for insertion therewith into the shank socket. The sleeve is conveniently a moulded plastics component which is a substantially complementary fit within the shank socket and receives the shank in substantially complementary manner. Such a sleeve may be easily renewed—usually upon replacement of the pick.

The pick head is provided with one or more of the outlet ports for water under pressure (supplied through the passage in the pick body) to be directed as required for dust suppression, flushing and/or cooling purposes. These outlet ports can be positioned at many locations on the pick head but our research has shown the desirability of having the, or at least one, outlet port located in the region of the cutting part to direct fluid to trail the cutting part in use of the pick. For example, we have found that a most effective position for the or an outlet port on a pick head which is fitted to a rotary driven drum of a coal cutter machine is where the outlet port trails the cutting part in the plane through which that cutting part moves arcuately during rotation of the drum and the water is sprayed outwardly in said plane to follow the cutting part; the reason for this is that the engagement of the cutting part on the mineral face frequently results in the formation of a trail of sparks and the directing of the water spray as aforementioned will cause the sparks to travel through the water spray to be cooled and thereby alleviate incendive sparking.

Embodiments of a mineral mining pick and of such a pick in combination with a pick holder will now be described, by way of example only, with reference to the accompanying illustrative drawings, in which:

FIG. 1 shows the combination of a coal mining pick in part section and a pick holder in section with a water passage in the pick communicating with a water supply passage in the holder through a co-operating socket and tubular spigot coupling, and FIGS. 2 to 6 are similar views of combined coal cutter picks and pick holders to that shown in FIG. 1 and illustrate modified arrangements for effecting water sealed couplings between the passages in the respective picks and the water supply passages in the respective holders.

The combination shown in FIG. 1 is primarily intended for heavy duty coal cutting and comprises a pick 1 mounted in a pick holder 2. The pick 1 is generally of conventional shape comprising a one piece steel body have a head 3 and a shank 4 which extends longitudinally therefrom. Mounted in the head 3 is a tungsten carbide insert 5 which forms a cutting part or tip to the pick. Provided in the holder 2 is a shank socket 6 which receives the shank 4 in substantially complementary manner, the shank being inserted longitudinally into the socket 6 through the mouth thereof.

The pick holder 2 will usually be in the form of a block or box which is secured for movement as part of a coal cutting machine to displace the cutting tip 5 as appropriate for coal cutting. Usually the holder 2 will be secured to a coal shearer drum which is rotatable about its longitudinal axis to effect cutting with the pick retained in the holder to project outwardly of the drum at a calculated angle of attack to the coal face. When in the form of a block or box the holder 2 will usually be welded to the drum, for example in the manner discussed in our U.K. Patent Specification No. 1,573,505, but it is possible for the holder 2 to be an integral part of the drum.

The pick 1 is secured in the holder 2 by retaining means 7 which is releasably engageable between the shank 4 and the holder 2. The retaining means 7 can be of conventional form such as, for example, a spring or resiliently biased stud or pin carried by the holder 2 which releasably engages with a recess in the pick shank or by a pin and cam slot locking arrangement such as that disclosed in our U.K. Pat. No. 1,170,979. In FIG. 1 the retaining means 7 is conveniently shown as a cam shaft 8 which is rotatably mounted in the holder 2 for movement between a locking condition as shown where the cam 8 co-operates with a recess 9 in the peripheral wall of the shank 4 to restrain withdrawal of the pick from the holder and a release condition where a flat 10 of the cam shaft is presented to the shank 4 so that the cam shaft is clear of the recess 9 to permit withdrawal of the pick.

Formed, conveniently by drilling, within the body of the pick is a passage 11 which extends longitudinally through the shank 4 and into the head 3 where it communicates with branch passages 11*a* and therethrough with outlet ports 12. The branch passages 11*a* are conveniently formed by drilling while the ports 12 may be provided with spray or jet nozzles. The pick and holder assembly when forming part of a coal shearer drum will, in use, be displaced circumferentially in the direction indicated by arrow A to effect coal cutting and it will be noted that one of the outlet ports 12 is directed to that the output therefrom leads the cutting tip 5 while the other outlet port 12 is directed so that the output therefrom trails the cutting tip 5.

The passages 11 and 11*a* are intended for the flow therethrough of water which is primarily intended for the purposes of dust suppression, flushing and cooling during coal cutting. Generally the water will emanate from a source within the coal cutting machine, usually a chamber within the coal shearer drum, and consequently provision is made within the pick·holder 2 for coupling the water supply to the passage 11. This coupling includes a tubular spigot 13 upstanding from the bottom wall 14 of the shank socket 6. The spigot 13 is received within a water coupling socket 15 which is formed in the free end of the shank 4 as an extension to the passage 11. The bore 16 of the tubular spigot communicates with the passage 11 and comprises part of a water supply passage 2*a* from a source of water under pressure within the coal shearer drum or other mining machine. Located within an annular recess 17 in the socket 15 of the shank is an annular pressure seal 18 for forming a water seal between the tubular spigot 13 and the shank 4. It will be realized from the drawing that the tubular spigot 13 will automatically mate with the fluid coupling socket 15 to effect a water seal with the seal 18 as the shank 4 is inserted longitudinally into the shank socket 6.

The tubular spigot 13 is mounted in the holder 2 by a tubular housing 19 having a male thread which engages with a female threaded bore 20 in the holder 2. An annular seal 21 is provided between a shoulder of the housing 19 and the bottom wall 14 of the shank socket. The spigot 13 extends through the bore of the housing 19 and is seated in a resilient sleeve 22, the inner face of which is bonded to the outer face of the spigot 13 which it receives and the outer face of which is bonded to the bore face of the housing 19 within which it is received. The resilient sleeve 22 permits a limited amount of lateral displacement for the tubular spigot 13 relative to the holder 2 and this displacement can serve to accommodate slight misalignment as may occur during mating between the socket 15 and the tubular spigot 13.

The assembly comprising the seal 21, the tubular housing 19, the spigot 13 and the sleeve 22 bonded therebetween is removable through the mouth of the shank socket 6 for replacement of servicing purposes.

However, since the tubular spigot 13, its mounting within the holder 2 and its coupling with the passage 11 are protected by the bulk of the holder 2 and that of the pick 1 when fitted to the holder, repair or replacement of the spigot assembly should be infrequent—so providing a relatively long life dust suppression water supply system. Furthermore, although the pick 1 will be replaced from time-to-time such replacement is a standard operating procedure in coal cutting equipment and can serve to provide new seals 18. The water outlet port 12 in the pick head 3 can be located to direct their respective sprays or jets of water to the appropriate positions for optimum dust suppression and cooling efficiency and this combined with the aforementioned protected water supply system will, it is believed, provide a relatively long life coal cutting system.

During use the shank socket 6 can be subjected to considerable wear and in a conventional pick holder wear on the socket can be to such an extent that replacement of the holder is necessary (usually by cutting out the holder from the coal shearer drum and welding in a new holder—this of course results in the machine being taken out of service. To alleviate this disadvantage and bearing in mind the aforementioned long life intentions for the holder in FIG. 1, the shank socket 6 is provided with a sleeve 23, conveniently formed as a moulding in plastics material such as nylon. The sleeve 23 is a substantially complementary fit within the shank socket 6 to be removable therefrom and receives the shank 4 in substantially complementary manner. An aperture 24 is provided in the sleeve 23 to permit engagement of the retaining means 7 between the pick shank and the holder 2. Naturally the sleeve 23 will be subjected to wear during use of the pick 1 and when necessary it can be replaced at relatively little expense.

In the event that detritus enters the shank socket 6, particularly during replacement of the pick 1, two apertures indicated at 25 are provided in the side wall of the shank socket 6 towards the bottom of the shank socket through which the detritus can be cleared. An appropriately shaped tool (not shown) can also be inserted through the apertures 25 to act as a wedge or lever on the end of the shank 4 for facilitating removal of the pick from the holder.

The pick 1 and holder 2 arrangements shown in FIGS. 2 to 6 are similar in many respects to the combination shown in FIG. 1 in particular in that in each case the water supply passage 2*a* from the pressure source communicates with the passage 11 in the pick through a socket and tubular spigot coupling. The primary difference between the arrangements shown in the various Figures is the manner in which the water supply is sealed within the combination of the pick and holder. Also in FIGS. 2 to 4, the outlet ports 12 are shown in different locations, in particular in FIG. 3 the outlet ports are provided in the side faces or flanges of the pick head 3 whereas in FIG. 4 an outlet port is located immediately adjacent to the cutting tip 5 to facilitate flow of water over the tungsten carbide insert. With the FIG. 4 arrangement the fluid passages in the pick can be constructed in the manner which is the subject of our copending U.K. Patent Application No. 80 37568. For convenience the water passages and outlet ports in the heads 3 of FIGS. 5 and 6 have not been shown, it being realised that such passages and outlet ports can be located and directed into the cutting region or otherwise as required for optimum water dust suppression detritus removal and/or cooling (which latter advantageously can include a reduction, and possible elimination, of incendive sparking)—this also being true of the pick head shown in each of the other Figures. Also, for convenience the pick retaining means 7 has been omitted from the arrangement shown in FIGS. 2 to 6 and such means can be of any convenient form, for example, to engage with the recess 9 in the respective pick shanks 4.

Figure 2:
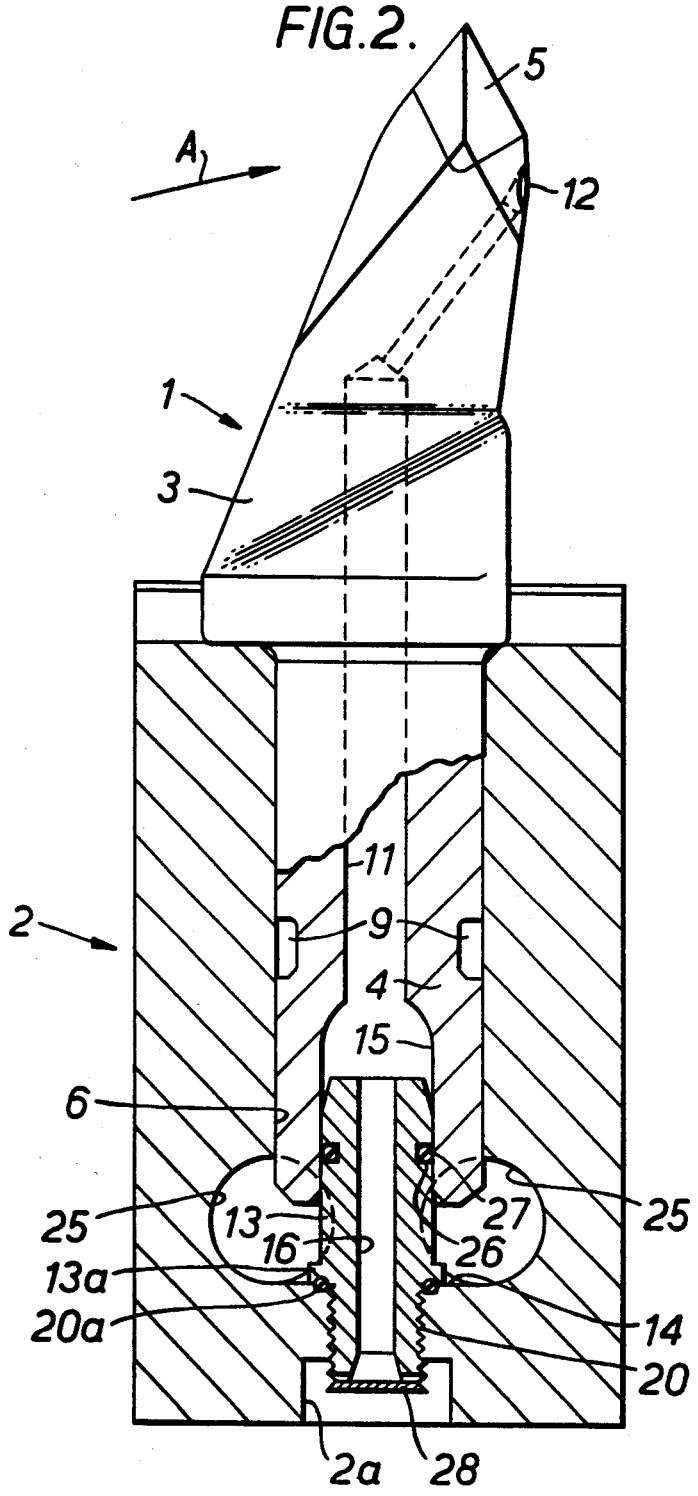

In FIG. 2 the tubular spigot 13 is provided with a male thread which engages within the female threaded bore 20 in the pick holder 2. In this Figure the spigot has an annular recess 26 within which is housed a sealing ring or cup seal 27 which forms a seal between the spigot 13 and the water coupling socket 15 of water passage 11. An 'O' ring fluid seal 20*a* is provided between the bottom wall 14 of the shank socket and a flange 13*a* on the tubular spigot 13. If required a filter 28 can be provided on the tubular spigot over its water passage 16 to alleviate the possibility of the outlet port 12 (particularly when in the form of a spray nozzle) from becoming obturated.

Figure 3:
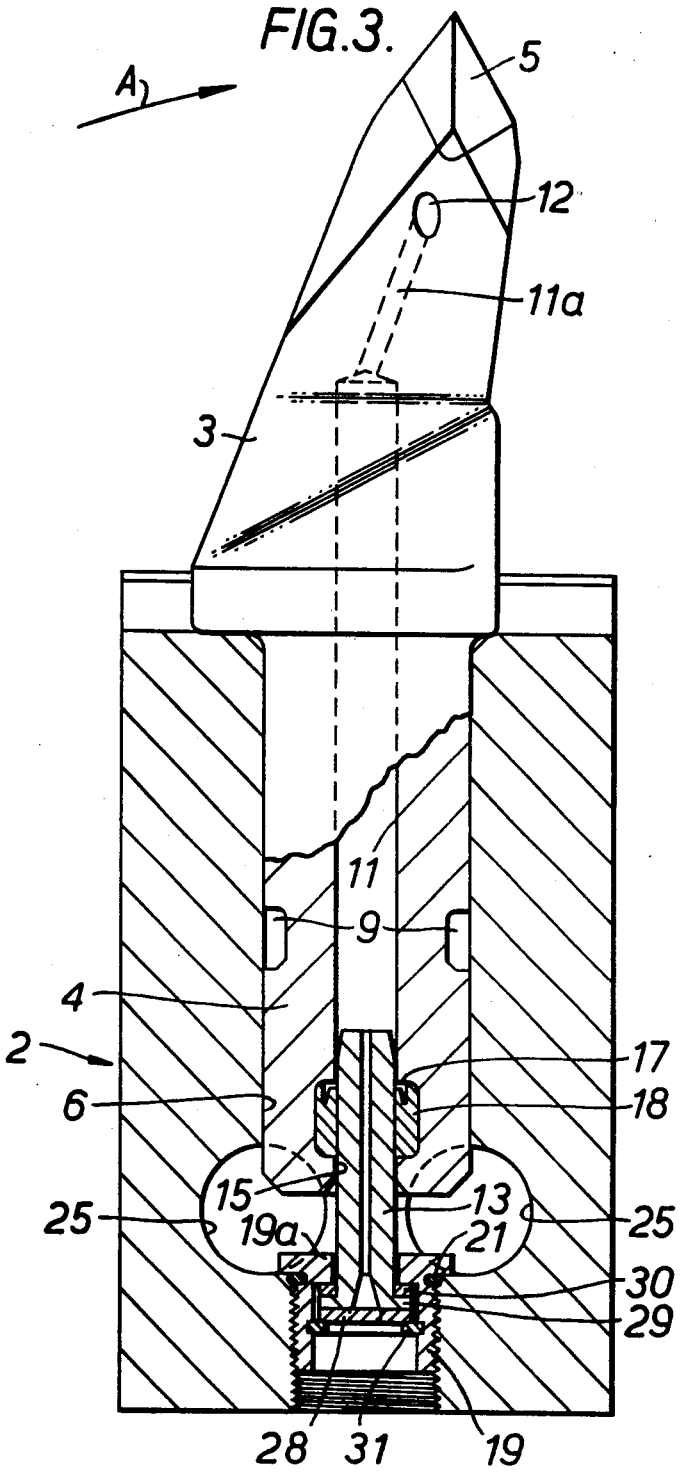

The sealing arrangement between the water coupling socket 15 and the tubular spigot 13 in the FIG. 3 arrangement is substantially the same as that shown in FIG. 1. However, in FIG. 3 the assembly of the spigot 13 with its threaded tubular housing 19 omits the bonded resilient sleeve 22 in the FIG. 1 arrangement and in FIG. 3 the spigot 13 extends upwardly within the shank socket 6 from the housing 19 and is restrained by an external flange 29 on the spigot 13 abutting (through an annular seal 30) a flange 19*a* on the housing 19. The flange 29 of the tubular spigot is retained against the flange 19*a* of the housing to compress the seal 30 by a circlip or similar spring clip 31 in the housing 19. If required, a water filter pad 28 can be interposed between the spring clip 31 and the flange 29.

Figure 4:
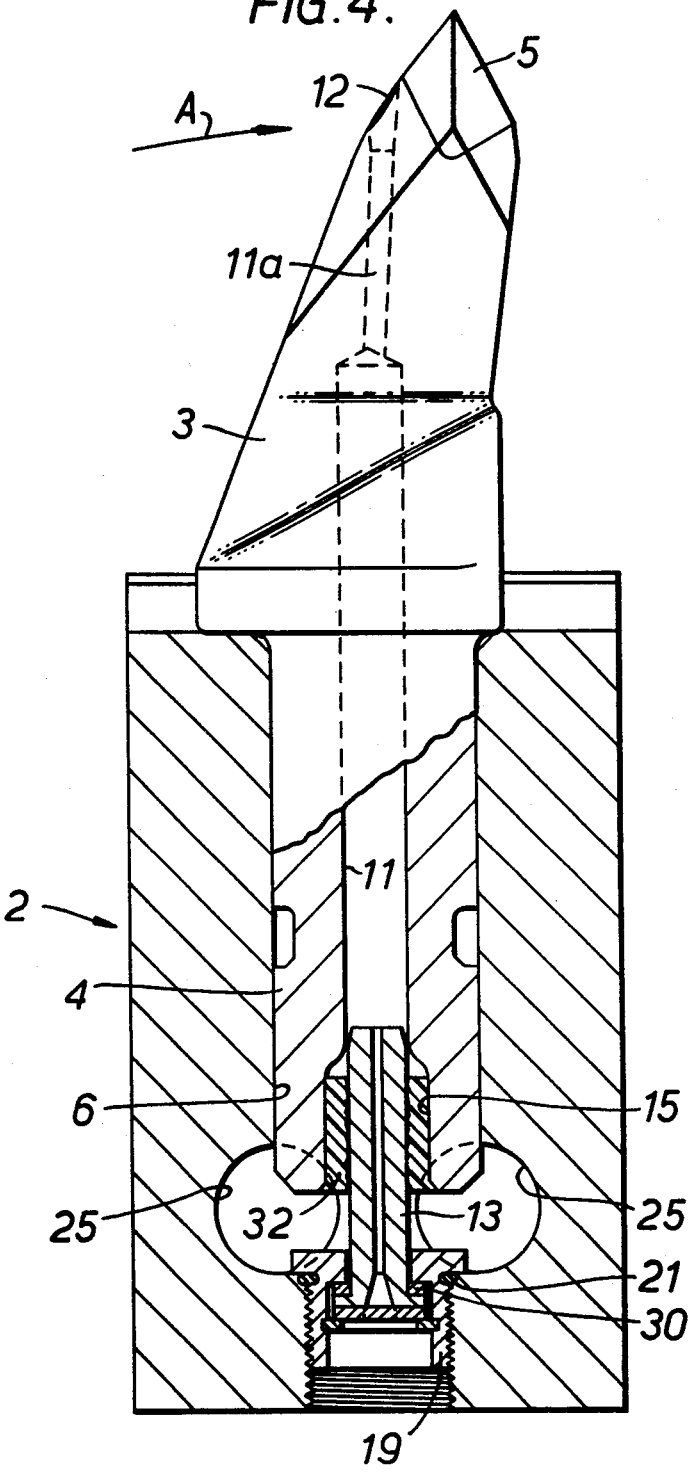

In the FIG. 4 arrangement the water coupling socket 15 in the pick shank 4 houses a sealing sleeve 32 of resilient elastomeric or plastics material such as nylon, the bore of which is provided with circumferential ridges to be of corrugated form. The sealing sleeve 32 is a tight press fit (preferably hammered) into the socket 15 and receives the tubular spigot 13 so that the corrugations deform sufficiently to effect a water seal.

Figure 5:
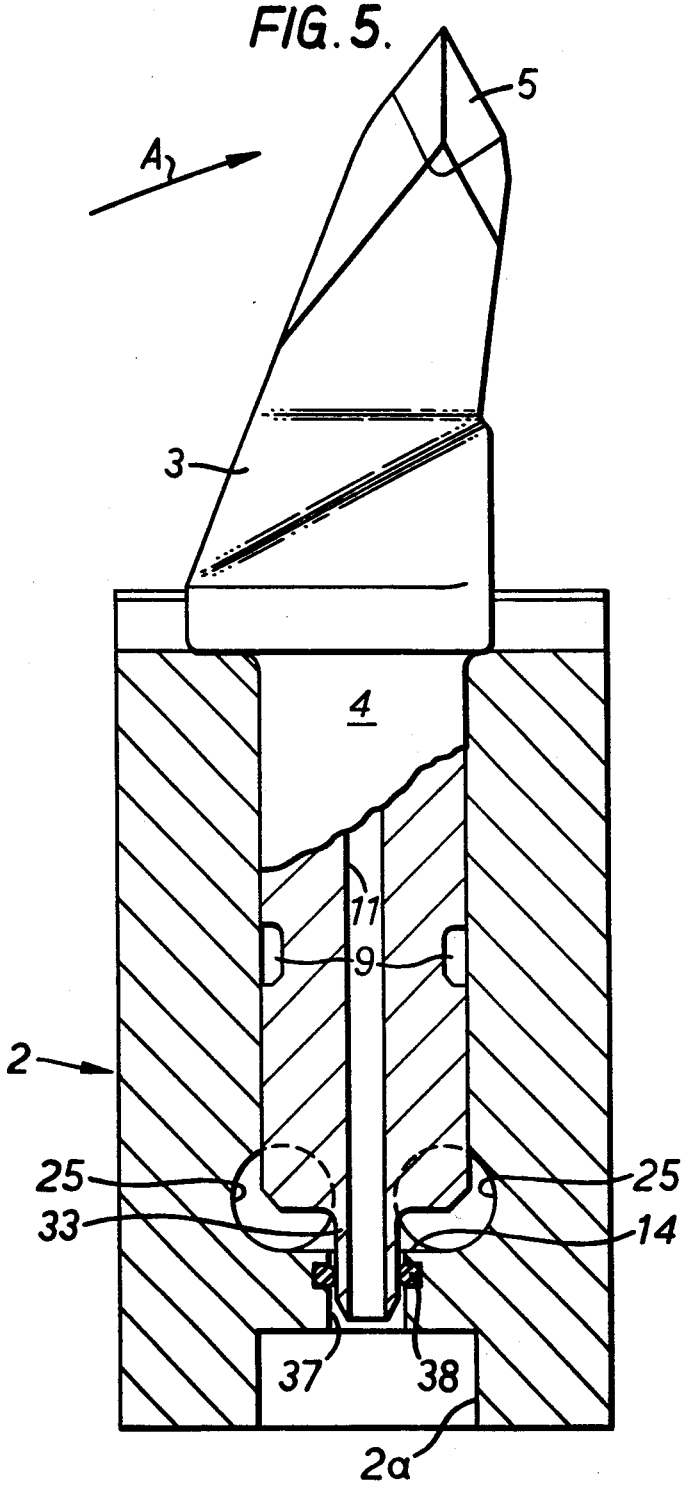

In the combination shown in FIG. 5 the shank 4 of the pick is provided at its inner end with a longitudinally extending tubular spigot 33. The spigot 33 is integrally formed with the shank and is located to be received in a socket part 37 which is provided in the bottom wall 14 of the shank socket so that the bore of the spigot 33 (which forms an extension to the passage 11) communicates with the supply passage 2*a*.

Figure 6:
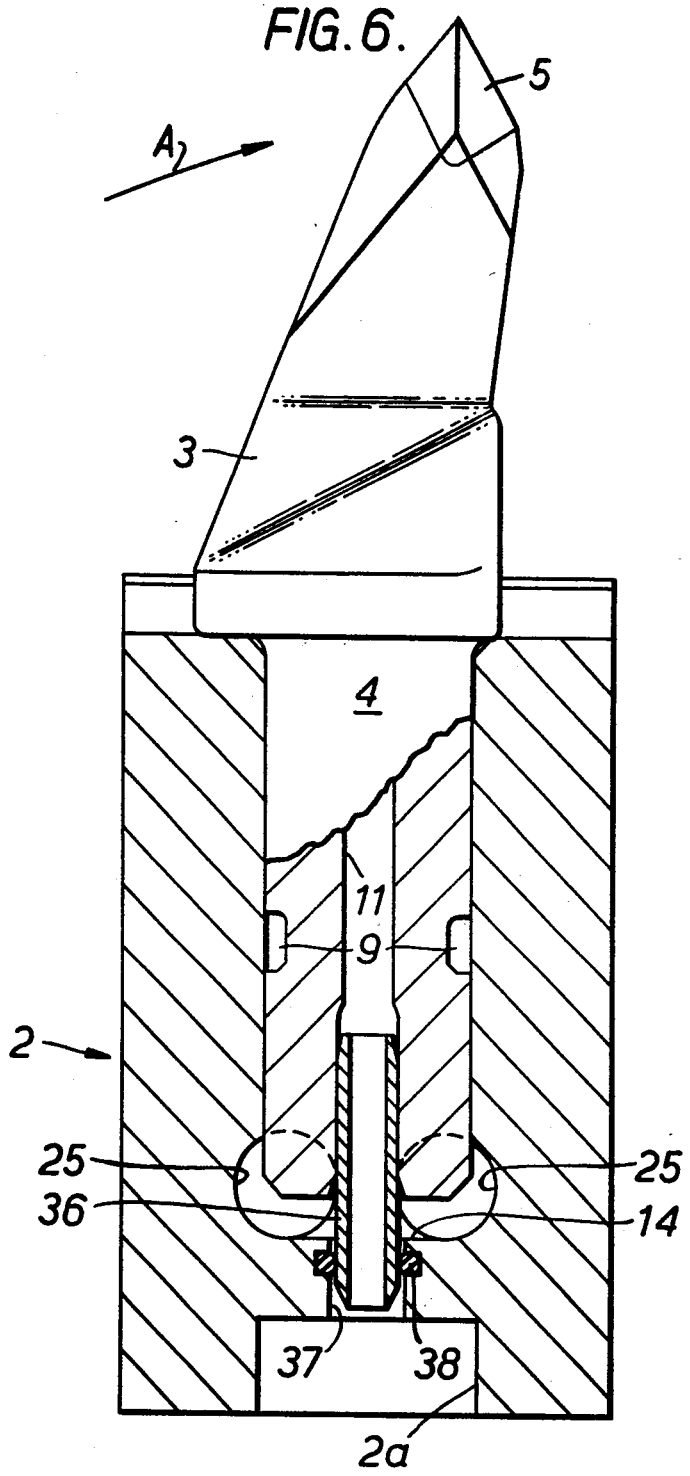

The arrangement shown in FIG. 6 is similar to that in FIG. 5 in so far as the pick shaft carries a tubular spigot however, in FIG. 6 the tubular spigot is provided by a tubular part 36 which extends longitudinally from the shank 4 to be received in the socket part 37. The tubular part 36 is conveniently formed by a metal (preferably steel) of plastics (preferably nylon) tube which is force fitted to be secured in the bore of passage 11.

The tubular spigots 33 and 36 are located so that they automatically mate with the socket part 37 as the shanks 4 are inserted into the shank sockets. One or more replaceable 'O' ring seals 38 are seated in appropriate annular recesses in the wall of the socket part 37 to form a seal against the tubular spigot 33 or 36 as the latter is push fitted into the socket part 37.

In each of the arrangements shown in FIGS. 2 to 6 the sleeve 23 in the FIG. 1 arrangement has been omitted but it will be realised that the provision of such a sleeve is optional. It will also be relaised that the sleeve 23 can be carried by the pick shank for insertion therewith as an assembly into the shank socket.

We claim:

1. A mineral mining pick for removable placement in a socket of a holder, said holder including a tubular spigot in communication with a fluid source and axially projecting in said socket, said pick comprising:

(a) an elongated body having a head at one end thereof for receiving a cutting element and a shank having a base at the other end thereof, said body including a fluid passage extending between an outlet port in said head and an inlet port in said base, said fluid passage and said inlet port being coaxial and disposed for telescopically receiving said spigot;

(b) a flexible, annular seal having a cylindrical bore coaxially located in said fluid passage for sealingly engaging said spigot between the telescopically-received projecting end thereof and said base, said bore being sized to permit axial and radial movement of said spigot while substantially preventing axial passage of fluid between said seal and said spigot; and (c) recess means communicating with said fluid passage proximate said base for receiving said seal and for substantially preventing axial movement of said seal.

2. The pick of claim 1 also including means in said shank for cooperating with said holder to fix said shank in said socket with said spigot telescopically received in said fluid passage.

3. The pick of claim 1 wherein said seal includes means responsive to fluid pressure in said passage for increasing sealing engagement with said spigot.

4. In a mechanical mineral mining machine including means for directing fluid to the cutting region for dust suppression, flushing and cooling, the improvement comprising:

(a) a pick comprising an elongated body having a head at one end thereof for receiving a cutting element and a shank having a base at the other end thereof, said body including a fluid passage longitudinally extending between an outlet port in said head and an inlet port in said base, said inlet port being substantially coaxial with said fluid passage;

(b) a holder including a shank socket in which the shank of said body is removably disposed, said socket including a bottom wall axially spaced from the base of said shank;

(c) a tubular spigot axially projecting from the bottom wall of said socket and having one end telescopically disposed in said fluid passage, said spigot being in communication with a fluid source for conducting fluid through said fluid passage to said outlet port;

(d) a flexible annular seal having a cylindrical bore coaxially located in said fluid passage for radially, sealingly engaging said spigot between said one end thereof and said base, said bore being sized to permit axial and radial movement of said spigot in said fluid passage while maintaining a sealing engagement therewith; and (e) recess means for receiving said seal and for substantially preventing axial movement of said seal, said recess means communicating with said fluid passage and being located axially between the one end of said spigot and said base.

5. The machine of claim 4 wherein said spigot is uniformly cylindrical substantially throughout its axial length and said fluid passage is uniformly cylindrical substantially throughout the length of said shank.

6. The machine of claim 4 in which said tubular spigot is mounted in the bottom wall of said holder to be removable therefrom through said shank socket.

7. The machine of claim 6 in which said tubular spigot is mounted by a screw threaded tubular housing.

8. The machine of claim 4 also including a replacable lining provided in said shank socket between said socket wall and the shank of said pick.

9. The machine of claim 8 wherein said lining comprises a sleeve within which said shank is received.

10. The machine of claim 8 wherein said lining is a molded plastics component.

11. The machine of claim 4 wherein said holder comprises a drum of said mineral mining machine and said pick extends outwardly of said drum, said drum being rotatable to displace said pick circumferentially to effect cutting and wherein said outlet port is located to direct fluid emerging therefrom to the path of said cutting.

12. The machine of claim 4 wherein said holder has at least one aperture in a sidewall thereof communicating with said shank socket proximate the bottom wall thereof to facilitate removal of detritus or the pick shank from the shank socket.

13. The machine as in claim 4 wherein said seal includes means responsive to fluid pressure in said passage for increasing sealing engagement with said spigot.

14. The machine as in claim 4 wherein said tubular spigot is resiliently mounted in said holder.

* * * * *

REEXAMINATION CERTIFICATE (1106th)

United States Patent [19]

Clemmow et al.

[11] B1 4,573,744

[45] Certificate Issued * Jul. 25, 1989

[54] PICK AND THE COMBINATION OF A PICK AND HOLDER

[75] Inventors: Raymond J. Clemmow, Dronfield Woodhouse; Leonard Radford, Meersbrook; John D. Thorpe, Sheffield, all of England

[73] Assignee: Paddey & Venables Limited, Dronfield, England

Reexamination Request:
No. 90/001,336, Sep. 25, 1987

Reexamination Certificate for:

| | |
|---|---|
| Patent No.: | **4,573,744** |
| Issued: | **Mar. 4, 1986** |
| Appl. No.: | **679,249** |
| Filed: | **Dec. 7, 1984** |

[ * ] Notice: The portion of the term of this patent subsequent to Dec. 18, 2001 has been disclaimed.

Related U.S. Application Data

[63] Continuation of Ser. No. 322,451, Nov. 18, 1981, Pat. No. 4,488,758.

[30] Foreign Application Priority Data

Nov. 24, 1980 [GB] United Kingdom ..... 8037567

[51] Int. Cl.[4] ..... E21B 10/18; E21C 7/08; E21F 5/02

[52] U.S. Cl. ..... 299/81; 175/393

[58] Field of Search ..... 299/81, 79, 91, 92; 175/339, 393; 277/168, 1, 212 R, 212 C, 212 F; 285/925

[56] References Cited

U.S. PATENT DOCUMENTS

| | | | |
|---|---|---|---|
| 901,392 | 10/1908 | Sigafoos | 175/189 |
| 1,531,315 | 3/1925 | Slater | 173/63 |
| 1,708,875 | 4/1929 | Skaer et al. | 219/528 |
| 1,799,473 | 4/1931 | Martin | 175/393 |
| 2,094,691 | 10/1937 | Williams | 277/1 |
| 2,160,158 | 5/1939 | Lind | 175/393 |
| 2,328,578 | 9/1943 | Payne | 277/91 |
| 2,408,892 | 10/1946 | Stokes | 175/393 |
| 2,443,145 | 6/1948 | Payne | 285/110 |
| 2,470,883 | 5/1949 | Boissou | 277/172 |
| 2,548,412 | 4/1951 | Walker | 277/201 |
| 2,668,691 | 2/1954 | Moore | 175/393 |
| 2,725,214 | 11/1955 | Lofqvist | 173/78 |
| 2,743,096 | 4/1956 | Wright | 299/93 |
| 2,751,235 | 6/1956 | Watts et al. | 277/70 |
| 3,236,543 | 2/1966 | Mueller | 285/2 |
| 3,290,097 | 12/1966 | Hlinsky et al. | 299/80 |
| 3,374,033 | 3/1968 | Arentzen | 299/81 |
| 3,390,897 | 7/1968 | Moore | 285/33 |
| 3,397,012 | 8/1968 | Krekeler | 299/86 |
| 3,544,166 | 12/1970 | Proctor | 299/81 |
| 3,767,265 | 10/1973 | French et al. | 299/81 |
| 3,827,755 | 8/1974 | Allen | 299/81 |
| 3,876,254 | 4/1975 | Parker | 299/81 |
| 3,990,730 | 11/1976 | Ekman | 285/110 |
| 4,012,077 | 3/1977 | Roepke et al. | 299/76 |
| 4,025,116 | 5/1977 | Roepke et al. | 299/17 |
| 4,062,595 | 12/1977 | Roepke et al. | 299/18 |
| 4,179,003 | 12/1979 | Cooper et al. | 175/371 |
| 4,186,946 | 2/1980 | Snow | 285/94 |
| 4,251,109 | 2/1981 | Roepke | 299/12 |
| 4,262,759 | 4/1981 | Young et al. | 175/227 |
| 4,269,436 | 5/1981 | Medney | 285/47 |
| 4,274,678 | 6/1981 | Herridge | 299/92 |
| 4,488,758 | 12/1984 | Clemmow et al. | 299/81 |

FOREIGN PATENT DOCUMENTS

| | | | |
|---|---|---|---|
| 2162256 | 6/1973 | Fed. Rep. of Germany | 299/91 |
| 738134 | 10/1955 | United Kingdom | 175/393 |
| 767324 | 1/1957 | United Kingdom . | |
| 952160 | 3/1964 | United Kingdom . | |
| 1006819 | 10/1965 | United Kingdom . | |
| 1057830 | 2/1967 | United Kingdom . | |
| 1061972 | 3/1967 | United Kingdom . | |
| 1092862 | 11/1967 | United Kingdom . | |
| 1144434 | 3/1969 | United Kingdom . | |
| 1160769 | 6/1969 | United Kingdom . | |
| 1170979 | 11/1969 | United Kingdom . | |
| 1258523 | 12/1971 | United Kingdom . | |
| 1266137 | 3/1972 | United Kingdom . | |
| 1333401 | 10/1973 | United Kingdom . | |
| 1362152 | 7/1974 | United Kingdom . | |
| 2008170 | 5/1979 | United Kingdom . | |
| 1573505 | 8/1980 | United Kingdom . | |
| 2104945 | 3/1983 | United Kingdom . | |

OTHER PUBLICATIONS

*McGraw-Hill Encyclopedia of Science & Technology*, 5th Edition, 1982, pp. 600–622.

F. Powell & K. Billinge, "The Use of Water in the Prevention of Ignitions Caused by Machine Picks", The Mining Engineer, (pp. 81–85, 8/1981).

Translation of K. Schriever and W-E Marx, "Verminderung der Zundgefahr von Grubengas Beim Arbeiten mit Teilschnitt-Vortriebsmaschinen", 41/1, Gluckhauf-Forschungshefte, pp. 17–21 (Feb. 1980).

*Primary Examiner*—Jerome W. Massie
*Assistant Examiner*—David J. Bagnell

[57] ABSTRACT

A mineral mining pick 1, a holder for such a pick, and the combination of such a pick with a holder 2. The pick has a head 3 with a cutting tip 5 and a shank 4 which is received in a shank socket 6 of the holder 2. Retaining means 7 is provided to releasably secure the pick in the holder. Extending through the pick is a water passage 11 which communicates with outlet ports 12 in the pick head for water flow to suppress dust and cool the tip 5. The passage 11 communicates with a socket 15 which mates with a tubular spigot 13 which is an extension to a fluid supply passage 2a in the holder 2. The spigot 13 is mounted by a resilient sleeve 22 in a tubular housing 19 by which it is removably retained in the holder 2. The sleeve 22 permits displacement of the spigot 13 to accommodate misalignment between the spigot and the socket 15 during coupling thereof as the shank is inserted into its socket 6.

The socket 6 is provided with a plastics moulded lining 23 which is replaceable when worn to alleviate wear on the holder 2.

In a modification the tubular spigot is carried by (and may be integral with) the pick shank for mating with a fluid coupling socket in the shank socket 6.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 is confirmed.

New claims 15–28 are added and determined to be patentable.

*15. A mineral mining pick for removable placement in a socket of a holder, said holder including a tubular spigot in communication with a fluid source and axially projecting in said socket, said pick comprising:*

*an elongated, one-piece, integrally-formed body having a head at one end thereof for receiving a cutting element and a shank having a base at the other end thereof, said body including a fluid passage extending between an outlet port in said head and an inlet port in said base, said fluid passage and said inlet port being coaxial and disposed for telescopically receiving said spigot;*

*a flexible annular seal having a cylindrical bore coaxially located in said fluid passage for sealingly engaging said spigot between the telescopically-received projecting end thereof and said base, said bore being sized to permit axial and radial movement of said spigot while substantially preventing axial passage of fluid between said seal and said spigot; and*

*recess means communicating with said fluid passage proximate said base for receiving said seal and for substantially preventing axial movement of said seal.*

*16. The pick of claim 15 also including means in said shank for cooperating with said holder to axially fix said shank in said socket with said spigot telescopically received in said fluid passage.*

*17. The pick of claim 15 wherein said seal includes means responsive to fluid pressure in said passage for increasing sealing engagement with said spigot.*

*18. In a mechanical mineral mining machine including means for directing fluid to the cutting region for dust suppression, flushing and cooling, the improvement comprising:*

*a pick comprising an elongated, one-piece, integrally-formed body having a head at one end thereof for receiving a cutting element and a shank having a base at the other end thereof, said body including a fluid passage longitudinally extending between an outlet port in said head and an inlet port in said base, said inlet port being substantially coaxial with said fluid passage;*

*a holder including a shank socket in which the shank of said body is removably disposed, said socket including a bottom wall axially spaced from the base of said shank;*

*a tubular spigot axially projecting from the bottom wall of said socket and having one end telescopically disposed in said fluid passage, said spigot being in communication with a fluid source for conducting fluid through said fluid passage to said outlet port;*

*a flexible annular seal having a cylindrical bore coaxially located in said fluid passage for radially, sealingly engaging said spigot between said one end thereof and said base, said bore being sized to permit axial and radial movement of said spigot in said fluid passage while maintaining a sealing engagement therewith; and*

*recess means for receiving said seal and for substantially preventing axial movement of said seal, said recess means communicating with said fluid passage and being located axially between the one end of said spigot and the said base.*

*19. The machine of claim 18 wherein said spigot is uniformly cylindrical substantially throughout its axial length and said fluid passage is uniformly cylindrical substantially throughout the length of said shank.*

*20. The machine of claim 18 in which said tubular spigot is mounted in the bottom wall of said holder to be removable therefrom through said shank socket.*

*21. The machine of claim 20 in which said tubular spigot is mounted by a screw threaded tubular housing.*

*22. The machine of claim 18 also including a replacable lining provided in said shank socket between said socket wall and the shank of said pick.*

*23. The machine of claim 22 wherein said lining comprises a sleeve within which said shank is received.*

*24. The machine of claim 22 wherein said lining is a molded plastics component.*

*25. The machine of claim 18 wherein said holder comprises a drum of said mineral mining machine and said pick extends outwardly of said drum, said drum being rotatable to displace said pick circumferentially to effect cutting and wherein said outlet port is located to direct fluid emerging therefrom to the path of said cutting.*

*26. The machine of claim 18 wherein said holder has at least one aperture in a sidewall thereof communicating with said shank socket proximate the bottom wall thereof to facilitate removal of detritus or the pick shank from the shank socket.*

*27. The machine of claim 18 wherein said seal includes means responsive to fluid pressure in said passage for increasing sealing engagement with said spigot.*

*28. The machine of claim 18 wherein said tubular spigot is resiliently mounted in said holder.*

* * * * *